United States Patent [19]

Stewart

[11] Patent Number: 5,056,391

[45] Date of Patent: Oct. 15, 1991

[54] STRIPPER FOR USE IN PRESSES AND IRONWORKERS

[76] Inventor: Robert C. Stewart, 1420-34 S. Rockwell St., Chicago, Ill. 60608

[21] Appl. No.: 638,339

[22] Filed: Jan. 4, 1991

Related U.S. Application Data

[63] Continuation of Ser. No. 477,310, Feb. 8, 1990, abandoned.

[51] Int. Cl.[5] ..... B26D 7/08

[52] U.S. Cl. ..... 83/139; 83/142; 83/698; 403/97; 403/380

[58] Field of Search ..... 83/136, 138, 139, 140, 83/142, 698, 640, 684, 686; 403/97, 380

[56] References Cited

U.S. PATENT DOCUMENTS

| | | | |
|---|---|---|---|
| 3,211,035 | 10/1965 | Whistler, Sr. et al. | 83/139 |
| 4,048,889 | 9/1977 | Finley | 83/139 X |
| 4,428,262 | 1/1984 | Vlahek | 83/139 |

OTHER PUBLICATIONS

George F. Marchant Company Catalog No. 72, p. 34, copyright 1970.

*Primary Examiner*—Mark Rosenbaum
*Assistant Examiner*—Kenneth E. Peterson
*Attorney, Agent, or Firm*—Trexler, Bushnell, Giangiorgi & Blackstone, Ltd.

[57] ABSTRACT

A stripper apparatus retains a workpiece in position relative to a punch press apparatus during the punching operation without marking or damaging a contacted surface of the workpiece. The stripper device is an axially elongate, resiliently compressible sleeve with a through axial bore which freely passes over the punch permitting the punch to travel therethrough. The stripper device removably attaches to a coupler or coupling portion which is also used to attach the punch to a punch stem of the punch press apparatus. Removable attachment is achieved utilizing keyways formed in the coupling portion and matingly engagable keys integrally formed on a corresponding surface of the stripper device. Additionally, peripheral flanges are integrally formed on the stripper which mate with the outside surface of the coupling portion to provide greater retention of the stripper device on the coupler. The stripper device eliminates the need for numerous stripper and punch combinations and permits easy removal of the stripper device from the coupler when necessary.

6 Claims, 2 Drawing Sheets

STRIPPER FOR USE IN PRESSES AND IRONWORKERS

This application is a continuation of application Ser. No. 07/477,310, filed Feb. 8, 1990 now abandoned.

BACKGROUND OF THE INVENTION

This invention relates generally to the punch and die arts and more particularly to a stripper device for stripping a workpiece from a punch upon extraction of the punch from the workpiece.

Punch and die operations are a common, widely used and well known operation in the metal processing industry. Punch and die sets are typically used for forming holes through workpieces and provide a high degree of accuracy, speed and efficiency in forming such holes. In a typical punch and die operation, a punch is attached to a punch press and is alignably positioned over a complementary stationary die into which it projects when compressed by the punch press. A workpiece is positioned between the punch and the die and the punch press is operated to force the punch through the workpiece and into the die thereby forceably removing a slug from the workpiece and creating a hole in the shape of the punch cross-section.

Since the punching operation is accomplished by applying substantial forces to the punch in order to force it through the workpiece, the workpiece tends to bind against the punch when the punch is extracted from the newly formed hole. The prior art resolved binding problems by utilizing a stripper which held the workpiece firmly against the die. Heretofore, typical strippers have been relatively large, generally U-shaped metal brackets or bars which are held forceably against the workpiece and having a large opening through which the punch traverses freely when advancing and retracting relative to the workpiece. The physical contact between these strippers and a workpiece permit the stripper to retain the workpiece against the die. When the punch is retracted, the stripper continues to push against the workpiece providing counteracting forces to overcome the binding forces of the workpiece on the punch.

While prior art strippers help eliminate problems caused by the workpiece binding on the punch, they are typically large unwieldy pieces and difficult to use along edges or in channel areas due to their general configuration and relatively large size. To overcome this problem, specific strippers were designed for specific problem situations. Accommodating specific problems with specifically designed strippers resulted in a wide variety of strippers requiring additional maintenance, inventory and cost.

An additional problem caused by all prior art strippers is that undesirable markings or even indentations are created on the abutting surface of the workpiece due to the forceful downward impact against the workpiece when the punch is upwardly extracted. The resulting marks and/or indentations sometimes must be worked out of the surface of the workpiece thereby increasing the time, worker effort and cost of the punching operation.

In order to overcome the problems of rigid strippers, it has heretofore been proposed to use a relatively hard neoprene sleeve on the theory that the spring-like action of the sleeve will have a stripping action similar to the stripper bar in the punching operation. A neoprene sleeve of this type is formed generally of a cylindrical shape being somewhat longer than the operative length of the punch. The additional length of the stripper sleeve positions the punch a distance away from the workpiece prior to punching. The stripper sleeve provides an elastically biasing body which acts to strip the work from the punch upon retraction of the punch.

While the stripper sleeve helps to prevent marking of the abutting workpiece surface, problems have arisen in that the stripper has commonly been attached directly to the punch thereby requiring a new punch and stripper combination each time the punch size is changed or the punch needs to be replaced. It would be preferred to replace the stripper sleeve only when required, as when a punch of a substantially different size or cross section is desired and not at every instance in which a punch is changed or replaced.

OBJECTS AND SUMMARY OF THE INVENTION

A general object of the present invention is to provide a stripper device which removably attaches to a coupler portion of a punch press apparatus.

Another object of the present invention is to provide a stripper device which is formed of a resiliently compressible material for retaining a workpiece relative to the punch press apparatus during a punching operation to prevent binding of the punch forced through the workpiece upon retraction of the punch therefrom.

Yet a further object of the present invention is to provide a stripper device which eliminates the need for large stripper bars to accommodate a variety of situations utilizing a common stripper device.

Briefly and in accordance with the following, a stripper device has been developed for use with a punch press apparatus for retaining a workpiece in position relative to the punch press apparatus during the punching operation. The stripper device is an axially elongate, resiliently compressible sleeve with a through bore which freely passes over the punch permitting the punch to travel therethrough. The stripper device removably attaches to a coupling portion which is used to attach the punch to the punch press apparatus. Removable attachment is achieved utilizing keyways formed in the coupling and matingly engagable keys integrally formed on a corresponding surface of the stripper device. Additionally, peripheral flanges are integrally formed on the stripper which mate with the outside surface of the coupling to provide greater retention of the stripper device on the coupler. The stripper device removably attached to the coupler eliminates the need for numerous stripper and punch combinations and permits easy removal of the stripper device from the coupler when necessary.

BRIEF DESCRIPTION OF THE DRAWINGS

The organization and manner of operation of the invention, together with the further objects and advantages thereof, may best be understood by reference to the following description taken in connection with the accompanying drawings in which like reference numerals identify like elements and in which.

Figure 1:
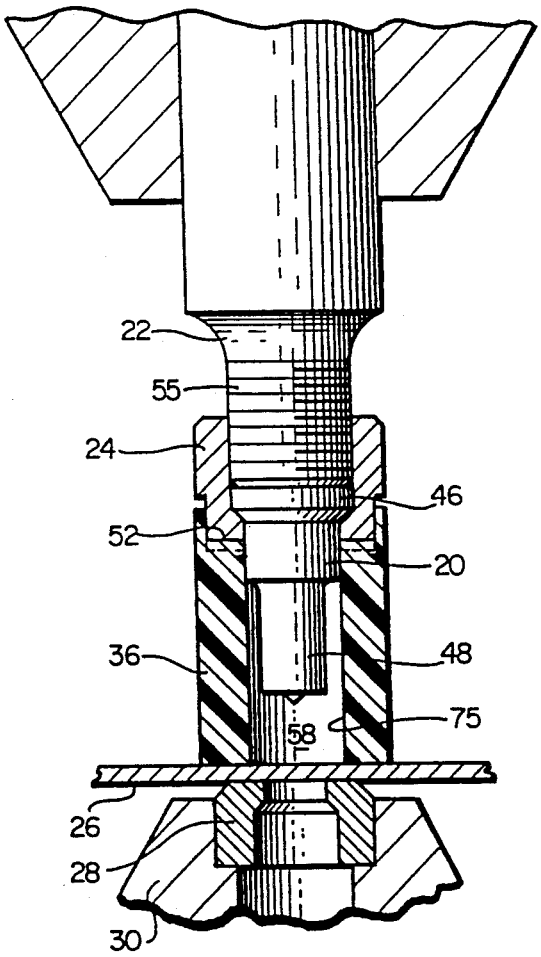
FIG. 1 is a side view, partially in section of a stripper device in accordance with the invention employed in a punch press operation.

It should be noted that dimensional relationships between the members of the illustrated embodiment may vary in practice and may have been varied in the illustrations to emphasize certain features of the invention.

DETAILED DESCRIPTION OF THE ILLUSTRATED EMBODIMENT

While this invention may be susceptible to embodiment in different forms, there is shown in the drawings and will herein be described in detail, a specific embodiment with the understanding that the present disclosure is to be considered an exemplification of the principles of the invention, and is not intended to limit the invention to the embodiment illustrated.

FIG. 1 provides a partial fragmentary side view of a punch member or punch 20 engaged with a threaded punch stem 22 by a coupler 24 to be forced through a workpiece 26. A die 28 retained in a die block 30 permits the punch 20 to pass through the workpiece and remove a slug 32 resulting in forming a hole 34 in the workpiece 26. A stripper device 36 in accordance with the invention retains the workpiece in place during the punching operation.

Figure 2:
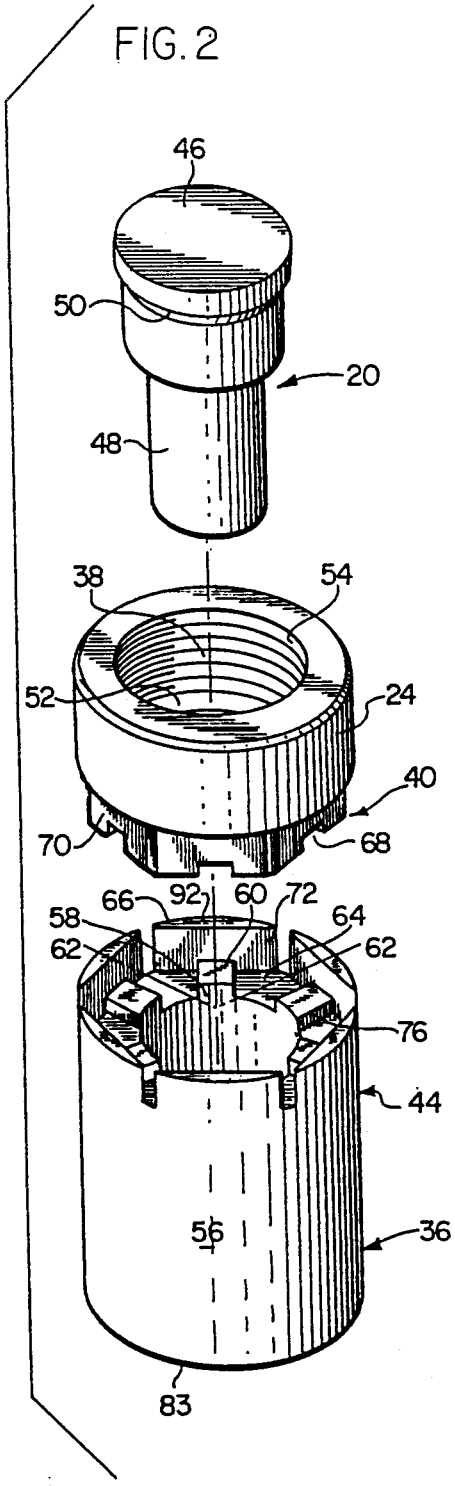
FIG. 2 is an enlarged exploded perspective view of the arrangement of a punch provided with a coupler and stripper device in accordance with the invention.

FIG. 2 illustrates the stripper device 36 in its relaxed or uncompressed state. As shown in the exploded perspective view of FIG. 2, the punch 20 projects through a center bore 38 of the coupler 24 and the coupler is formed with a hex shaped lower portion 40 which matably engages attachment means 42 formed on a top portion 44 of the stripper 36. The attachment means 42 integrally permit removable attachment of the stripper 36 to the coupler 24 without the use of further mechanical fasteners.

The punch 20 is formed with a head 46 and a shank 48. The head 46 has a slightly inwardly beveled surface 50 which fits into a corresponding punch seat 52 formed on the inside of the coupler 24. Threads 54 are formed on the surface of the center bore 38 above the punch seat 52. These threads 54 permit the coupler 24 to be engaged with corresponding punch stem threads 55 formed on the punch stem 22. This threading arrangement permits the punch 20 to be removably attached to the punch stem 22 thereby permitting removal of one punch for replacement by another punch.

As shown in FIG. 2, the stripper 36 has an axially elongate cylindrical body portion 56 through which is formed a punch bore 58. As mentioned above, the top portion 44 of the stripper 36 is integrally formed with attachment means 42. The attachment means 42 include a series of keys 60 formed centered on radii 62 of the body 36 which bisect each side of a hexagonal area 64 of complementary form with hexagonal end 40 of the coupler 24, which is formed in the attachment means 42 of the stripper 36. The keys 60 removably insert or interengage with key ways, grooves or slots 68 formed in the lower hex shaped portion 40 of the coupler 24 for removably attaching the stripper 36 to the coupler 24. Upwardly projecting peripheral flanges 66 are integrally formed in the stripper material between the outer perimeter of the stripper 36 and the outer edge of the hexagonal area 64, which the flanges 66 generally define.

Figure 4:
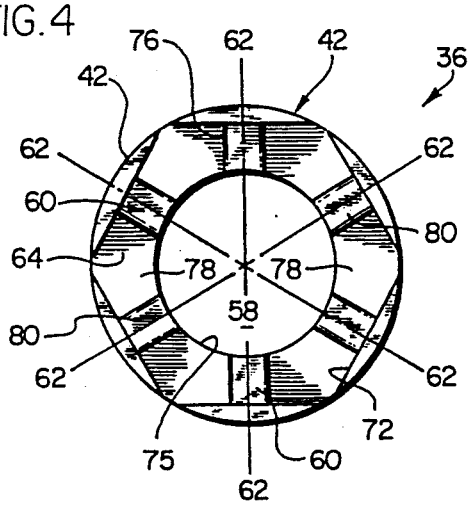
FIG. 4 is a top view of the stripper device showing retaining means and a central axially extending punch bore.

FIG. 4 provides a top view of the retaining means 42. More specifically, each key 60 extends radially from an edge 75 of the punch bore 58 outwardly along a respective radius 62 to a corresponding one of the bounding sides of the hexagonal area 64, which sides are defined by the inner surfaces 72 of the flanges 66.

While the keys 60 are shown as cross sectionally rectangular structures, keys having other cross sectional shapes may be utilized. Generally, however, it is preferred that the two opposed sides 76, 76 of each key 60 be formed generally parallel each other to permit ease of engagement and disengagement as well as sufficient retaining forces with the corresponding grooves 68 of the coupler 24.

Figure 5:
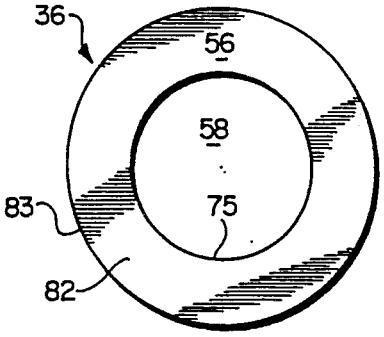
FIG. 5 is a bottom view of the stripper device.

Planar areas 78 between the keys 60 as well as key tops 80 sustain and distribute the impact of the punch press apparatus transferred through the coupler 24 to the body 56 of the stripper 36. Since the attachment means 42 are symmetrical about radii 62, when the stripper is compressed the forces exerted on the surfaces 78, 80 are generally uniformly distributed thereby promoting uniform compression of the stripper body 56. The forces compress a bottom surface 82 of the stripper 36 against an abutting face 84 of the workpiece 26 positioned thereunder. As shown in FIG. 5, the stripper 36 has a flat annular bottom surface 82 the outer diameter of which is defined by the outer lateral side surface 83 of the cylindrical stripper body 56, the inner diameter of which is defined by the punch bore 58.

Figure 6:
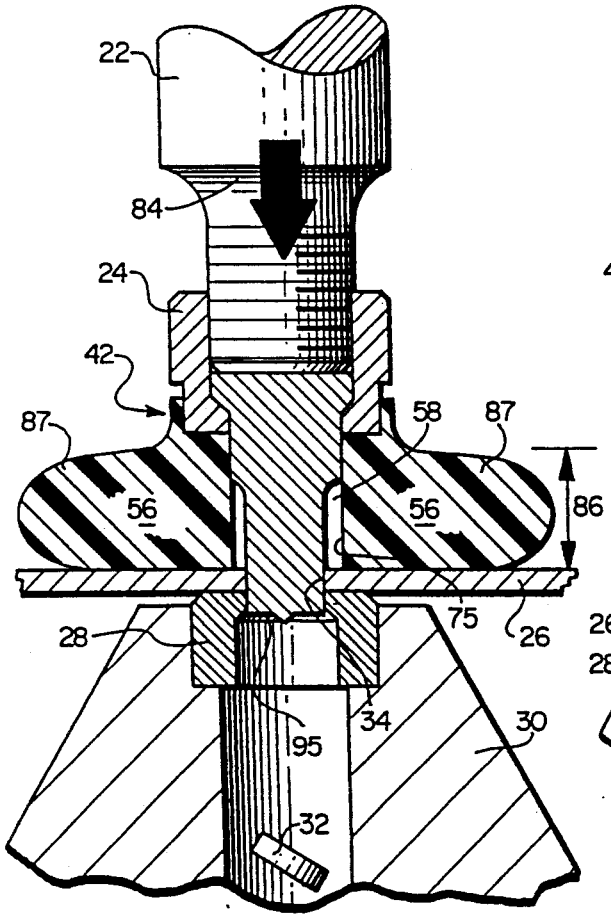
FIG. 6 is a partial fragmentary side view of the punch press and stripper device during a punching operation.
Figure 7:
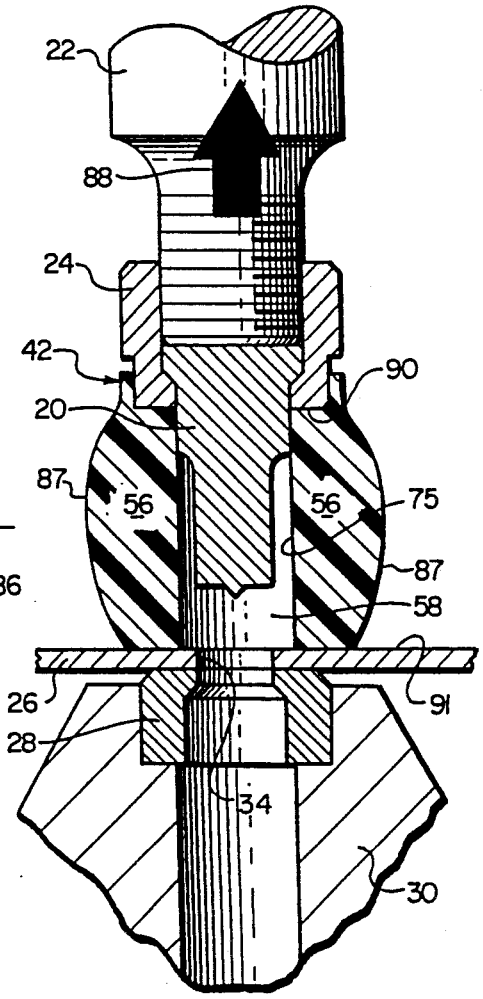
FIG. 7 is a partial fragmentary side view of the punch press operation as shown in FIG. 6 when the punch is withdrawn from a workpiece through which it has formed a hole.

The stripper 36 is an integrally formed, single-piece, generally cylindrical body formed of a resiliently compressible, elastically deformable material. The material used in forming the stripper 36 is a relatively hard neoprene material. More specifically, the preferred embodiment is formed of a neoprene material known as Uniroyal L-167, a MOAC cure neoprene having a 95 Shore hardness. Although this type of neoprene feels rather hard to the touch, under the substantial forces created during a punch press operation, the neoprene stripper 36 deforms and returns to its original shape as illustrated in FIGS. 6 and 7. Further, even though the stripper 36 is rigid to the touch, the compressibility of the neoprene material used in forming the stripper is such that it does not create marks or indentations in the abutting face of the workpiece 26. The resilient elastic character of the neoprene material permits numerous consecutive compressions of the stripper in a punching operation without irreversibly compressing the material and without detrimentally changing the properties of the material.

Figure 3:
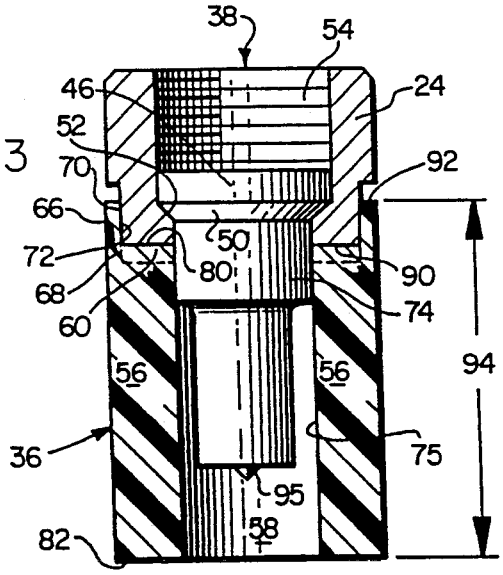
FIG. 3 is a side view, partially in section, of the punch coupler and stripper device as illustrated in FIG. 2 when assembled for use with a punch press apparatus.

When the stripper 36 is engaged with the hex shaped portion 40 of the coupler 24, as shown in FIG. 3, the key ways 68 engage the keys 60. The inwardly facing surfaces 72 of peripheral flanges 66 are shown in abutting engagement with the outwardly facing surface 70 of the hex shaped lower coupler portion 40. Also shown in FIG. 3 is a cross sectional view through a key 60 showing in broken line the engagement of the inner surfaces of a key way 68 therewith. It is the engagement of these respective sets of mating surfaces which provides retention of the stripper 36 on the coupler 24 without employing additional discrete mechanical fasteners or other fastening means.

As further shown in FIG. 3, the stripper 36 and punch bore 58 are sized and dimensioned to permit free movement of the punch 20 therethrough. A more closely dimensioned upper shank 74 retains the punch 20 in axial alignment within the punch bore 58 as the punch 20 is forced through a workpiece 26.

FIGS. 6 and 7 provide partial fragmentary side views of the sleeve during a compressive stroke (FIG. 6) and a retracting stroke (FIG. 7) of a punching operation. As shown in FIG. 6, compressive forces indicated by the arrow 84 are applied by a punch press apparatus and transferred to the punch stem 22 and consequently to the punch 20 retained thereon by engagement with the coupler 24. The releasably attached stripper 36 is non-bindingly compressibly deformed to a lesser thickness, as illustrated by dimension 86, upon full extension of the punch 20 through the workpiece 26 and into the die 28. When compressed, the stripper body 56 forms outward bulges 87 whereupon the neoprene material forming the stripper 36 stores potential energy transferred during the compressive stroke. At maximum compression, as shown in FIG. 6, the punch tip 95 sufficiently passes through the workpiece and into the die 28 to force the slug 32 clear of the hole 34 formed in the workpiece 26.

Once the hole 34 is formed, the compressive forces 84 are released and the punch is retracted upwardly as illustrated by arrow 88 of FIG. 7. Upon retraction of the punch 20 from the newly formed hole 34, the potential energy stored in the compressed stripper body 56 provides compressive biasing between an underside 90 of the coupler 24 and the upwardly facing surface 91 of the workpiece 26. These biasing forces prevent the workpiece from lifting up away from the die 28 as the punch 20 is extracted from the hole 34 even in the event of binding between the hole 34 and the punch 20. After the punch 20 clears the hole 34, and until full retraction, the body 56 is still somewhat compressed and acts to dissipate any post extraction shocks which may be transmitted through the workpiece 26.

In its relaxed state as shown in FIGS. 1 and 3, the stripper body 56 has a total height measured from an uppermost surface 92 on top of the peripheral flanges 66 to the bottom surface 82 as indicated by dimension 94. This dimension 94 is selected to be at least slightly greater than the effective length of the punch 20, i.e., that portion thereof which projects from the coupler 24. That is, the height of the relaxed body 36 is such that the punch end 95 is held some minimum distance above the workpiece 26 when the lower surface 82 contacts the workpiece 26.

While particular embodiments of the present invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent after study. As such, the scope of the invention should not be limited by the particular embodiment and specific construction described herein, but should be defined in the depended claims and equivalents thereof. Accordingly, the aim of the appended claims is to cover all such changes and modifications as fall within the true spirit and scope of the invention.

The invention is claimed as follows:

1. A stripper device adapted for use with a punch press apparatus for retaining a workpiece in position relative to said punch press apparatus during and subsequent to punching, said punch press apparatus having a punch member which is forcibly driven through said workpiece for forming an aperture therethrough and coupler means for attaching said punch to said punch press apparatus, said stripper device comprising: an axially elongate body integrally formed as a single piece of a generally uniform resiliently compressible material and having a top end abutting the punch apparatus and a bottom end distal said top end, a punch bore formed through said body and extending through said top end and said bottom end, and formed and dimensioned for receiving said punch freely extending therethrough, attachment means integrally formed in said single piece of generally uniform material on said top end for removably interengageably attaching said body to said coupler means, said attachment means comprises keys integrally formed on said single piece of generally uniform material on said top end of said stripper device of complementary form for engagement with mating key ways formed on said coupler, said keys and key ways being formed for removably attaching said body to said coupler, said attachment means include peripheral flanges integrally formed on said single piece of generally uniform material projecting away from said top end, said peripheral flanges defining an internal dimension cooperatively dimensioned with an external dimension of said coupling means to resiliently, removably engage said peripheral flanges over an external surface of said coupling means for removably attaching said resiliently compressible body on said punch press apparatus.

2. A stripper device according to claim 1 wherein lateral walls of said axially elongate body are formed of a generally consistent dimension between an outside radius of said body and an inside radius of said bore formed therethrough, said body being non-bindingly deformable around said punch projecting therethrough.

3. A stripper device according to claim 1 wherein said device is integrally formed as a single piece of neoprene.

4. A stripper assembly comprising: a stripper device and coupler means for coupling a punch to a punch press apparatus, said stripper device being removably attachable on said coupler means positioned between said punch press apparatus and a workpiece for retaining said workpiece relative to said punch press apparatus when said punch is advanced into and withdrawn from said workpiece; said stripper device comprising an axially elongate single piece body integrally formed of a generally uniform elastically deformable resiliently compressible material, said body having a top end abutting said coupler means and a bottom end for engaging a workpiece axially spaced from said top end, attachment means integrally formed upon said body on said top end thereof for releasable interengageable attachment to said coupler means, a bore formed through said body for freely receiving said punch therethrough, said body being in its uncompressed state at least slightly longer than said punch retained by said coupler means and projecting through said bore; said attachment means further comprising complementary interengageable key and key way means including at least one upwardly protruding key formed on said top end of said body and at least one key way formed in and cooperatively positioned on an abutting surface of said coupler means for receiving said key, said key being removably retainably insertable into said key way when said stripper device is brought into contact with said coupler means for attaching said stripper device to said coupler means; said coupler means being formed with a polygonal exterior surface and said attachment means include integrally formed peripheral flanges on said single piece of generally uniform material projecting upwardly from said top end, said peripheral flanges being resiliently engageable over said polygonal surface of said coupler means for retaining said stripper device on said coupler.

5. A stripper assembly comprising: a stripper device and coupler means for coupling a punch to a punch press apparatus; said stripper device being removably attachable on said coupler means and positioned for retaining said workpiece relative to said punch press apparatus when said punch is advanced into and withdrawn from said workpiece; said stripper device comprising an axially elongate single piece body integrally formed of an elastically deformable resiliently compressible material, said body having a top end abutting said coupler means and a bottom end for engaging a workpiece axially spaced from said top end, attachment means integrally formed on said top end for releasable interengageable attachment to said coupler means, said attachment means including interengageable keys and key ways including at least one upwardly protruding key integrally formed on said top end of said body and at least one key way formed in and cooperatively positioned on an abutting surface of said coupler means for receiving said key, said key being removably retainably insertable into said key way when said stripper device is brought into contact with said coupler means for attaching said stripper device to said coupler means, said coupler means being formed with a polygonal exterior surface and said attachment means being integrally formed with peripheral flanges projecting upwardly from said top end of said body, said peripheral flanges being resiliently engageable over said polygonal surface of said coupler means for retaining said stripper device on said coupler, a bore formed through said body for freely receiving said punch therethrough, said body being at least slightly longer in an uncompressed state than said punch retained by said coupler means and projecting through said bore.

6. A stripper assembly comprising: a stripper device and coupler means for coupling a punch to a punch press apparatus, said stripper device being removably attachable on said coupler means positioned between said punch press apparatus and a workpiece, said stripper device retaining said workpiece relative to said punch press apparatus when said punch is advanced into and withdrawn from said workpiece; said stripper device comprising an axially elongate single piece body integrally formed of an elastically deformable resiliently compressible material, said body having a top end abutting said coupler means and a bottom end for engaging a workpiece axially spaced from said top end; a bore formed through said body for freely receiving said punch therethrough, said body being at least slightly longer than said punch when said body is in an uncompressed state; attachment means integrally formed on said top end for releasable interengagable attachment to said coupler means, said attachment means including interengagable key and key way means including at least one upwardly protruding key formed on said top end of said body and at least one key way formed in and cooperatively positioned on an abutting surface of said coupler means for receiving said key, said key being removably retainably insertable into said key way when said stripper device is brought into contact with said coupler means for attaching said stripper device to said coupler means; said attachment means further comprising complementary means formed on said coupler means for releasably receiving said top end of said body, coupler means being formed with a polygonal exterior surface and said attachment means include integrally formed peripheral flanges projecting upwardly from said top end, said peripheral flanges being resiliently engagable over said polygonal surface of said coupler means for retaining said stripper device on said coupler.

* * * * *

UNITED STATES PATENT AND TRADEMARK OFFICE

CERTIFICATE OF CORRECTION

PATENT NO. : 5,056,391

DATED : October 15, 1991

INVENTOR(S) : Robert C. Stewart

It is certified that error appears in the above-identified patent and that said Letters Patent is hereby corrected as shown below:

Column 3, Line 44 "engages attachment means 42 formed on a top portion 44 of the stripper 36. The attachment means 42 integrally permit"

to

— engages attachment means 42 integrally formed on a top portion 44 of the stripper 36. The attachment means 42 permit —

Signed and Sealed this

Thirtieth Day of March, 1993

*Attest:*

STEPHEN G. KUNIN

*Attesting Officer*

*Acting Commissioner of Patents and Trademarks*